US005788539A

United States Patent [19]

Fedder

[11] Patent Number: 5,788,539

[45] Date of Patent: Aug. 4, 1998

[54] SURFACE MOUNTABLE ELECTRICAL CONNECTOR

[75] Inventor: James Lee Fedder, Etters, Pa.

[73] Assignee: The Whitaker Corporation, Wilmington, Del.

[21] Appl. No.: 963,476

[22] Filed: Nov. 3, 1997

Related U.S. Application Data

[63] Continuation of Ser. No. 655,514, May 30, 1996, abandoned.

[51] Int. Cl.[6] ..... H01R 13/11

[52] U.S. Cl. ..... 439/682; 439/74; 439/83

[58] Field of Search ..... 439/74, 75, 83, 439/357, 358, 444, 733.1, 682

[56] References Cited

U.S. PATENT DOCUMENTS

| | | | |
|---|---|---|---|
| 3,955,869 | 5/1976 | Licht | 439/682 |
| 4,597,625 | 7/1986 | Seidler | 439/682 |
| 4,605,277 | 8/1986 | DeFilippis et al. | 439/444 |
| 4,813,881 | 3/1989 | Kirby | 439/74 |
| 4,992,056 | 2/1991 | Douty et al. | 439/83 |
| 5,169,322 | 12/1992 | Frantz et al. | 439/82 |
| 5,263,883 | 11/1993 | Kirayoglu | 439/856 |
| 5,487,678 | 1/1996 | Tsuji et al. | 439/358 |
| 5,536,177 | 7/1996 | Casey | 439/74 |

FOREIGN PATENT DOCUMENTS 07263091 10/1995 Japan .

*Primary Examiner*—J. J. Swann

*Attorney, Agent, or Firm*—Katherine A. Nelson; Anton P. Ness

[57] ABSTRACT

A surface mounted miniature electrical connector (12) includes a housing (14) having at least a pair of terminal-receiving cavities (30), each having an electrical terminal (40) disposed therein. Each terminal (40) includes a planar body portion (48) having a contact-receiving receptacle (41) defined at one end and a solder tail (56) extending from the other end. The body portion (48) is disposed along a central wall (22) of the housing (14) dividing the at least one pair of terminal-receiving cavities (30) with the solder tail (56) extending outwardly of the housing cavity (30) and then at a right angle to the body portion (48) along the mounting face (26) of the connector (12). The solder tail (56) extends beyond an outer wall (16) of the housing (14) to a contact section (60) adjacent a free end thereof for electrical connection to a respective circuit pad of a circuit board. The length of each solder tail (56) is maximized along the mounting face (26) between the body portion (48) and the contact section (60).

5 Claims, 4 Drawing Sheets

SURFACE MOUNTABLE ELECTRICAL CONNECTOR

This application is a Continuation of application Ser. No. 08/655,514 filed May 30, 1996, now abandoned.

FIELD IN THE INVENTION

This invention relates to electrical connectors and in particular to surface mounted electrical connectors that are relatively small in size.

BACKGROUND OF THE INVENTION

With the increased use of miniaturized electronic components such as cellular telephones, microphones and the like, it is desirable to provide electrical connectors that are miniature in size, require a minimum amount of spacing on circuit board and are highly reliable. It is also desirable to eliminate the use of mounting ears and other devices to hold the connectors to the circuit board. The miniaturization of the housings and terminals reduces the height available for connecting and disconnecting the terminals as well as the reducing the space available for structures to retain the terminals within the housing as well as securing the housing to circuit boards. Additionally the miniaturized connectors may have problems with solder wicking since there is typically only a short length of solder tail contact available for surface mounting to the board.

When manufacturing miniature connectors it is often desirable to eliminate flanges and other extraneous mounting means and to relay solely on the soldering of the surface mounted terminals to the circuit board. The housing needs to withstand the soldering temperatures associated with surface mounting terminals to boards as known in the art. One problem with miniature connectors having, for example, only two contacts therein is that the soldering temperature causes some relaxation of the dielectric material such that the housing is no longer retained by the terminals. The use of miniature connectors having a large number of terminals minimizes the problems associated with retaining the housing on the terminals since the retention force is dividing among all of the terminals. The problem is particularly associated with connectors having only a few, such as two terminals in the housing that are bottom loaded into the housing. Concomitant with this is the associated problem of retaining a mating plug onto a receptacle having only two terminals. It is desirable, therefore, that the housing provide a latching system to assure that the two connectors will remain attached until it is desired to unmate them. While it is desirable to have precious metal plating, such as gold or the like, at the mating interface of the connector, it is less desirable to have such plating at the contact section of the solder tails because of the problems associated with solder wicking into the mating interface.

U.S. Pat. No. 5,169,322 shows one miniature electrical connector that uses barrel-like socket terminals that are surface mounted to a circuit board. These terminals are drawn parts and when plated with gold or other noble metals the entire surface of the terminals receive that plating, making thus the terminals expensive to manufacture. It is desirable, therefore, to have a miniaturized connector using a stamped and formed terminal that can be selectively plated and furthermore can be securely held in the housing without the use of additional flanges or mounting means to secure the connector to the circuit board.

SUMMARY OF THE INVENTION

An electrical connector adapted for surface mounting to a circuit board includes a housing having opposed mating face and mounting faces, at least two terminal-receiving cavities extending therebetween, and an electrical terminal disposed in each cavity. The terminal includes a planar body portion having a pair of arms co-extending orthogonally from opposed side edges thereof, and a solder tail. When disposed in the cavities, each electrical terminal defines a contact-receiving receptacle proximate the mating face of the housing and the solder tail extends outwardly of the housing cavity and then at a right angle to the body and along the mounting face of the housing. The solder tail extends beyond an outer wall of the housing to a contact section adjacent a free end thereof for electrical connection to a respective circuit pad. The body portion of the terminal is disposed along a central wall of the housing that divides the at least one pair of terminal-receiving cavities, thereby maximizing the length of the solder tail along the mounting face between the body portion and contact section. The present invention is particularly suitable for miniature electrical connectors especially those having only a few terminals therein.

In the preferred embodiment the connector housing further includes a latching protrusion extending outwardly from opposed sidewalls that cooperate with a mating housing having latch arms thereon to secure the receptacle to a mating plug. The terminals in the preferred embodiment also include "duplex plating" such that the surface mounted contact section is plated with tin/lead for solderability and the contact-receiving receptacle at the mating face of the connector is plated with gold or other noble metals or alloys, as known in the art, for reliability, with a portion of terminal therebetween being nickel plated to define a solder barrier to prevent wicking of the solder into the electrical connector.

It is an object of the present invention to provide a miniature electrical connector particularly suitable for use in surface mounting to closely spaced circuit pads on a circuit board.

It is a further object to the invention to provide a miniature electrical connector having a contact that is cost effective to manufacture, has high reliability and is securely held within the connector housing.

An embodiment of the invention will now be described by way of example with reference to the accompanying drawings

DETAILED DESCRIPTION OF THE DRAWINGS

For purposes of illustration, the invention will be described in relation to a two position receptacle connector.

It is to be understood that the contacts and housing structure herein may be used with connectors having greater than two positions.

Figure 1:
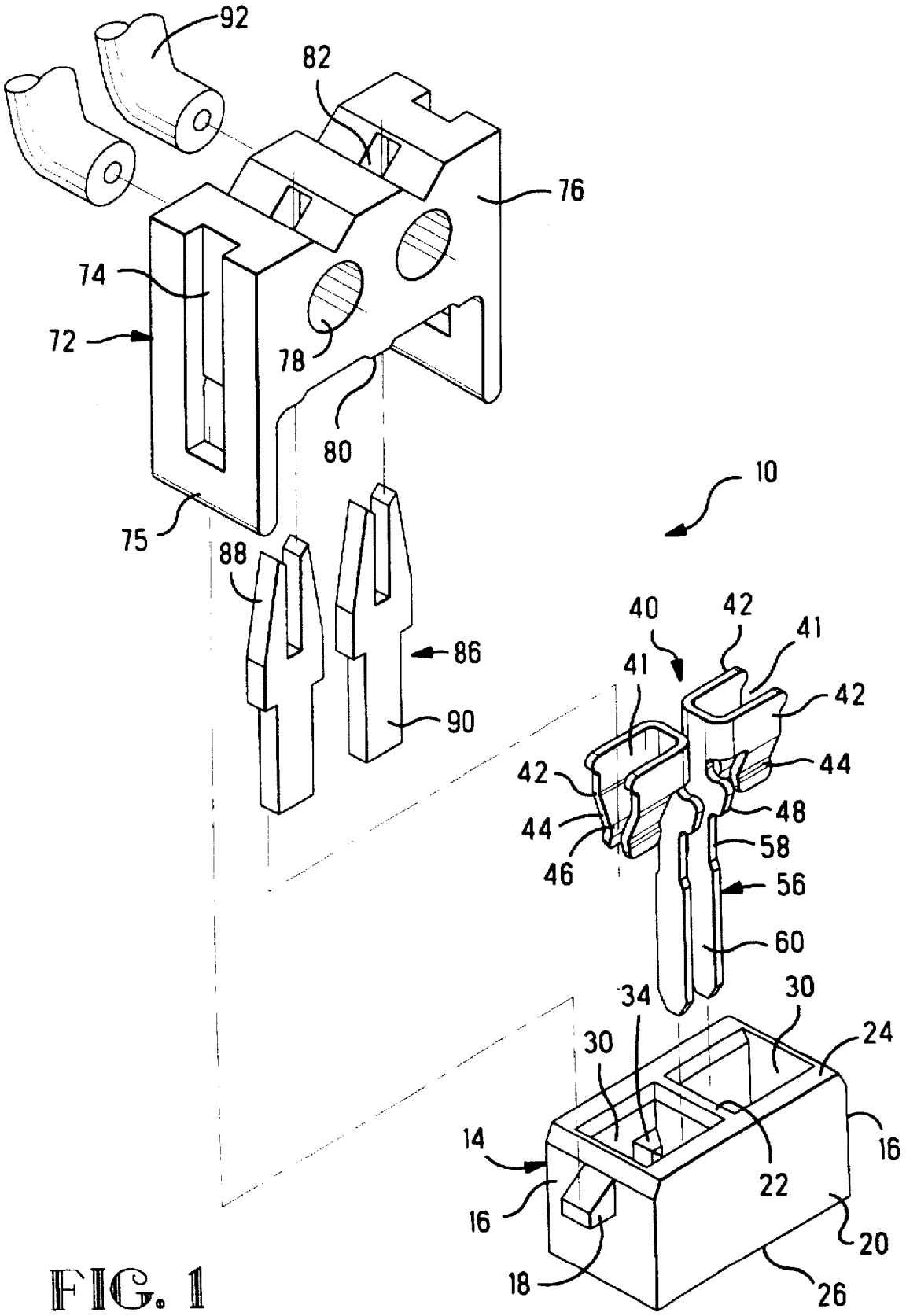
FIG. 1 is an isometric view of the connector assembly made in accordance with the present invention with the parts exploded from one another.
Figure 2:
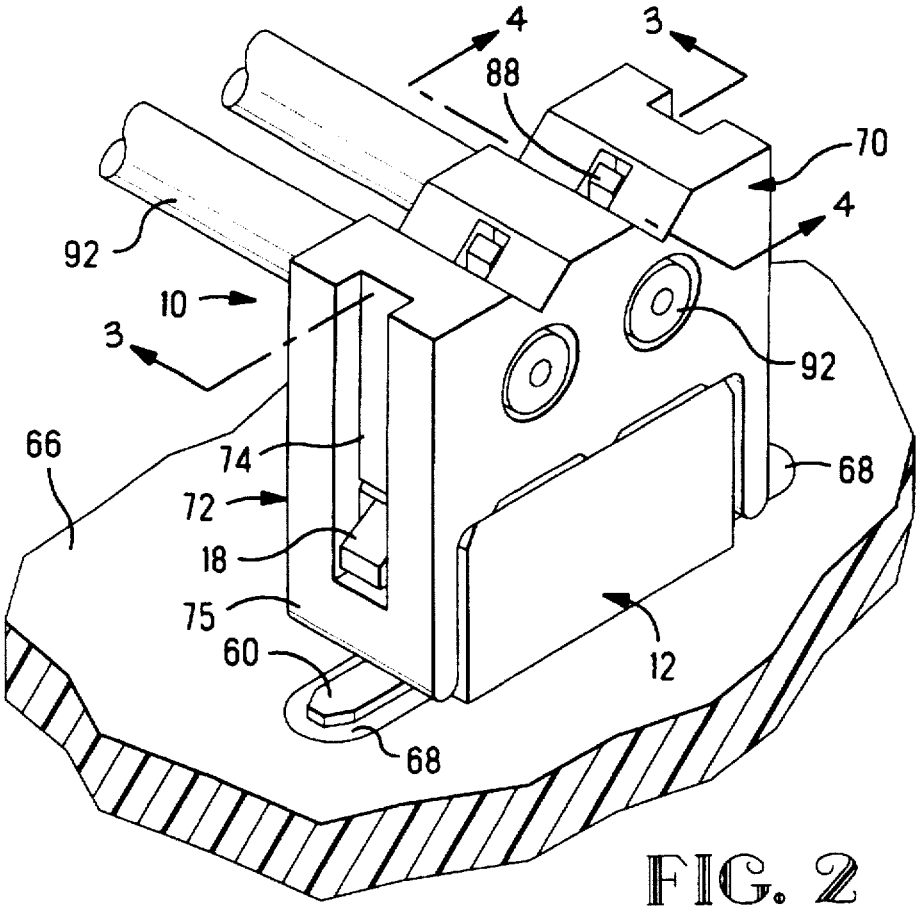
FIG. 2 is an isometric view of the assembled mated connector assembly of FIG. 1.
Figure 5:
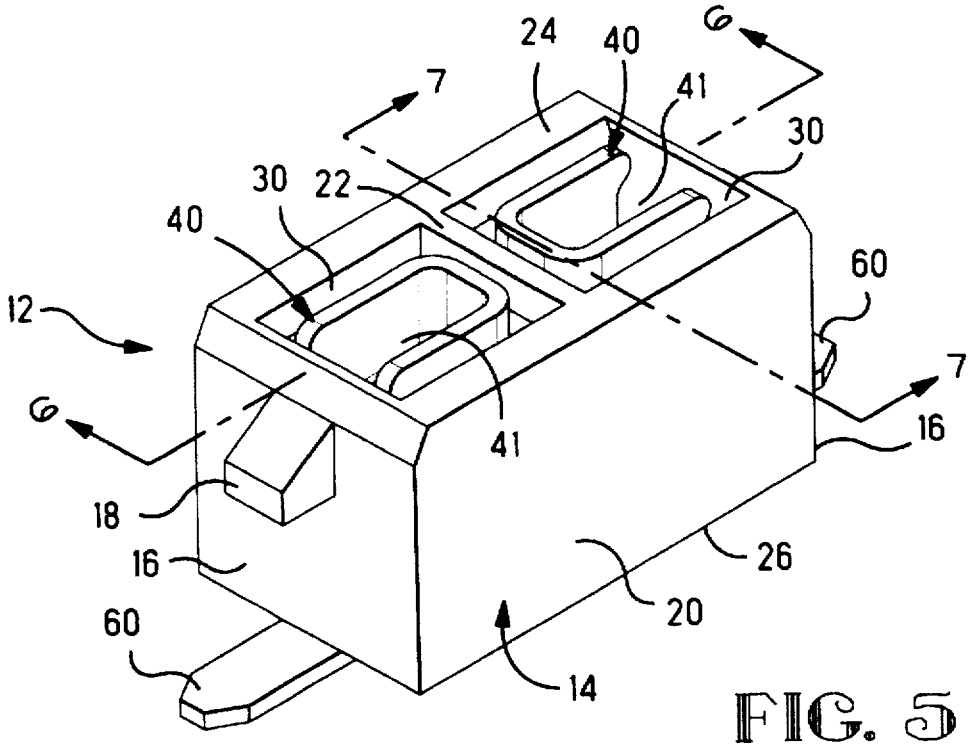
FIG. 5 is a isometric view of the receptacle connector made in accordance with the present invention.
Figure 3:
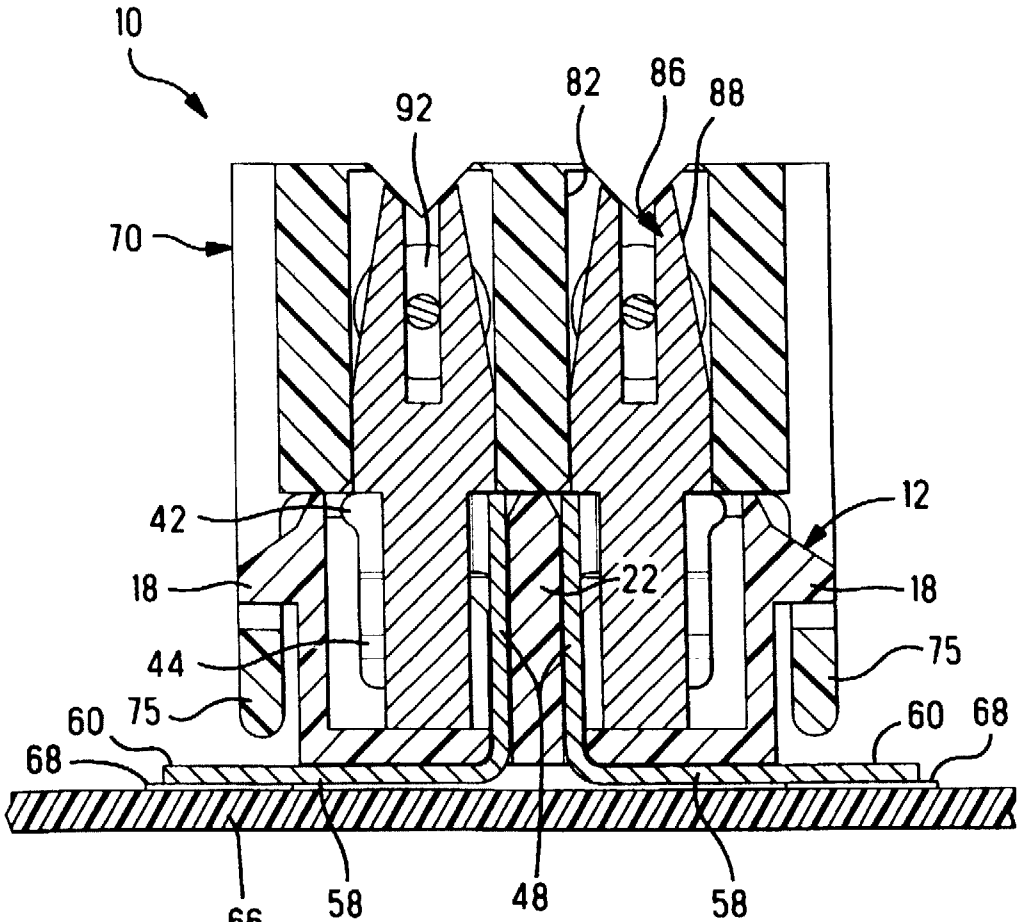
FIG. 3 is a sectional view of the connector assembly taken along line 3—3 of FIG. 2.
Figure 7:
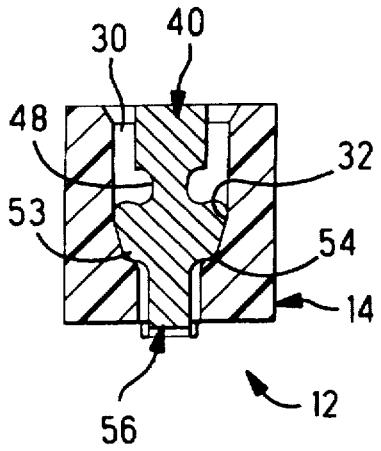
FIG. 7 is an enlarged fragmentary view taken along line 7—7 of FIG. 5 illustrating the retention portion of the terminal secured within the housing passageway.

Referring first to FIGS. 1 and 5 through 8, the receptacle electrical connector 12 adapted for surface mounting to a circuit board 68, as shown in FIG. 3, includes a housing 14 having two terminal receiving cavities 30 and two receptacle terminals 40 disposed therein. The housing 14 includes opposed first side walls 16 having a protruding latch 18 thereon and opposed walls 20 with a central wall 22 extending between sidewalls 20 and defining the two terminal receiving cavities 30, which extend between mating face 24 and mounting face 26. The cavities 30 have a constricted portion 32 proximate wall 22 adapted to receive and retain the corresponding retention portion 53 of the terminal 40 upon disposing the terminal 40 into cavity 30, as shown in FIG. 7 and described more fully below. In the preferred embodiment the housing is molded from a suitable high temperature thermoplastic material that can withstand the temperatures associated with soldering surface mounted terminals, as known in the art.

Electrical terminal 40 includes a planar body portion 48 having a contact-receiving receptacle 41 at one end and a solder tail 56 at the other end thereof. Solder tail 56 includes a first portion 58 extending between the body portion 48 and a surface mountable contact portion 60 at the free end of solder tail 56. The contact-receiving receptacle 41 includes a pair of arms 42 co-extending orthogonally from opposite side edges 52 of the planar body portion 48. Arms 42 include contact beams 44 having opposed contact surfaces 46 thereon adapted to electrically engage terminals 86 of a mating connector shown representatively as 70 in FIGS. 1–4. The body portion 48 further includes a retention portion 53 having stop surfaces 54 thereon that engage cooperating stop surfaces 34 within the constricted portion 32 of the cavity 30 in receptacle housing 12, as shown in FIG. 7.

The terminal 40 is preferably made from stamping a pre-plated metal strip having nickel plating thereon, with a stripe of tin-lead plating along one outer edge that will become contact portion 60 and a stripe of precious metal plating at the area that will become the contact-receiving receptacle thereof, to provide reliability at the contact interface, as known in the art. To prevent-solder wicking into the connector housing, it is preferable that the solder tail 56 have a portion 58 having only nickel plating to act as a solder barrier.

Figure 6:
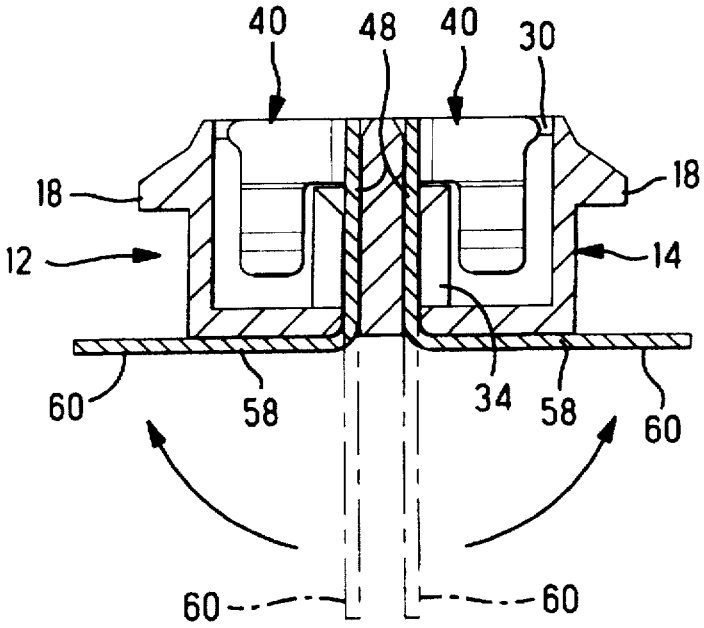
FIG. 6 is a cross-sectional view taken along the line 6—6 of FIG. 5.
Figure 8:
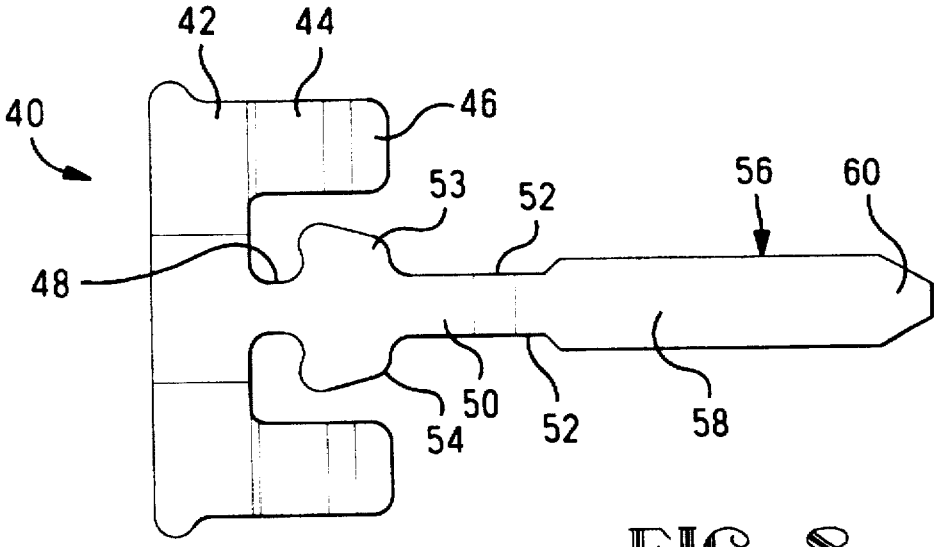
FIG. 8 is a flat plan view of the blank used for forming a receptacle contact.

The receptacles of contacts 40, as shown in FIG. 6, are formed and the contacts 40 are mounted into the housing cavity 30 from the mating face 24 thereof with the major surface 50 of body portion 48 adjacent the central wall 22 and the retention section 54 secured within the cavity 30 by the stop surfaces 34, 54 and deformation of plastic material along the wall surface of constricted portion 32 as the contact 40 is inserted in an interference fit as shown in FIG. 7. Stop surfaces 54 face toward mounting face 26 while cooperating stop surfaces 34 of the housing face toward mating face 24, so that terminals 40 hold housing 14 to the circuit board after soldering. After the terminals 40 have been secured in the housing 14, the solder tails 56 are bent at a substantially right angle such that the first portion 58 lies adjacent the mounting face 26 and the contact portion 60 extends from adjacent to the center wall 22 and outwardly therefrom, and then outwardly from side walls 16 for electrical connection to a respective pad 68 on circuit board 66 as shown in FIGS. 3 and 6 presenting a major surface adjacent to the circuit pad for a large surface area. The contact portions 60 can be visually inspected to assure the connector is properly soldered to the board. As can be seen in FIG. 3, the length of the solder tails is maximized by positioning body 48 against central wall 22 as opposed to the inner surface of an outer wall 16, thus providing an area that has nickel plating only, which provides a solder barrier. Thus, the surface area of the solder tail presented adjacent the circuit pad is maximized for soldering.

This receptacle configuration is particularly suitable for miniature electrical connectors. For example, in one embodiment of the present invention, the receptacle connector having two cavities is about 2.79 mm wide by 1.52 mm long and 1.59 mm high. The overall dimensions of the connector assembly are 3.51 mm×1.52 mm×2.59 mm. The thickness of the housing walls is approximately 0.17 mm, the thickness of the stock used for the terminals is approximately 0.1 mm. The structure of the housing of the present invention allows for approximately 1.1 mm of the solder tail 58 to extend along mounting face 26 of housing 14 thus providing sufficient room for a nickel barrier between the tin-lead plating of the surface mounted contact 60 and the precious metal plating of the contact-receiving receptacle 41.

Because the terminals 40 are top loaded into the housing cavities 30 and the solder tails 56 are bent after insertion, the terminals 40 and housing 14 are securely held together. Even if the housing relaxes during the soldering process, the housing cannot separate from or be easily removed from the terminals.

Figure 4:
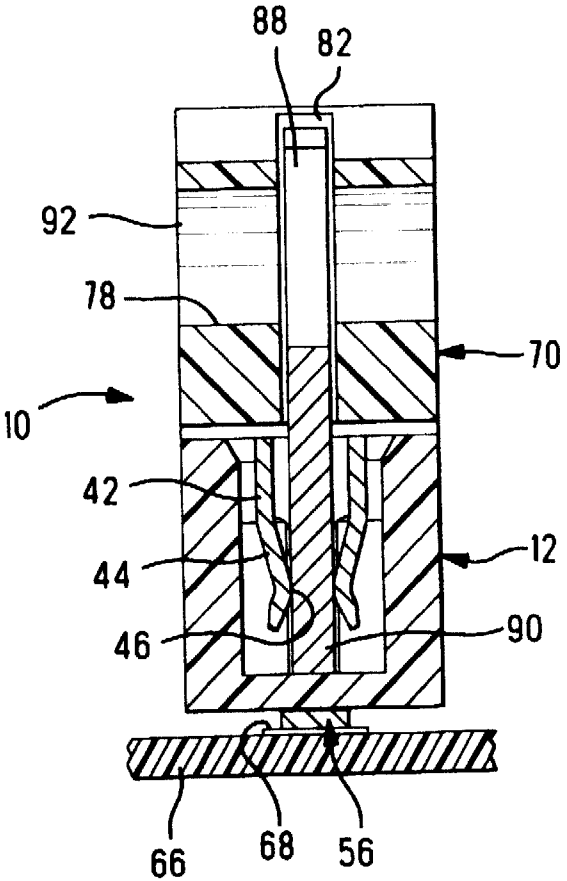
FIG. 4 is a sectional view of the connectors assembly taken along line 4—4 of FIG. 2.

FIGS. 1 through 4 illustrate a representative plug connector 70 matable with the receptacle connector 12 of the present invention. Connector 70 includes a housing 72 having end walls 74, each with a latch arm 75 extending therefrom cooperable with the latch protrusions 18 of the receptacle connector 12, opposed side walls 76 having two wire receiving apertures 78 extending therethrough and two terminal receiving cavities 82 extending to a mating face 80. As shown in the embodiment plug terminals 86 have insulation displacement contact sections 88 adapted to engage wires 92 inserted through apertures 78. Contacts 86 further include a contact section 90 adapted to be received between the contact beams 44 and engage the respective contact surfaces 46 of the receptacle contacts 40 as best seen in FIGS. 3 and 4. Connector 70 is assembled by first inserting wires 92 into respective apertures 78 and inserting contacts 86 into cavities 82 to terminate 35 them to wires 92. As shown in the assembled connector of FIG. 2, the latch arm 75 engages the latch protrusions 18 upon mating connectors 70 and 12 to form the connector assembly 10.

The terminals of the present invention and the associated receptacle housing are particularly suited for miniature, low profile connectors having only a few terminals. The terminals overcome the problem of separation of the housing and terminals associated with a small number of terminals that are bottom loaded into a housing. The connector assembly further provides a positive latch arrangement for securing the mating connectors together. The connector assembly of the present invention is cost effective to manufacture. The housings are molded in a conventional pull mold. The terminals are stamped from a pre-plated strip of metal thus minimizing the assembly process. The solder tails of the terminals are of sufficient length to allow for a nickel barrier to prevent solder wicking into the receptacle contact area.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. A miniature electrical connector adapted for surface mounting to a circuit board having at least a pair of circuit pads spaced apart a selected distance, comprising:

a housing having opposed sides and further having a mating face, a mounting face and at least one pair of terminal-receiving cavities extending therebetween, each of said cavities disposed on a respective one of said sides of said housing; and an electrical terminal disposed in each of said cavities, said terminal including a planar body portion having a pair of arms co-extending orthogonally from opposed side edges thereof proximate said mating face defining a U-shaped channel comprising at one end a contact-receiving receptacle open to said mating face, and a solder tail extending from said body portion traversing said U-shaped channel at an opposed end along said mounting face to a contact section adjacent a free end of said solder tail for electrical connection to a respective circuit pad, said body portion being disposed along a central wall of said housing parallel to said sides of said housing, said central wall separating the cavities of each said at least one pair of terminal-receiving cavities, and said solder tail of each said terminal extending outwardly of the housing cavity and then being bent at a right angle to said body portion to extend along said mounting face and outwardly away from adjacent said central wall and beyond an outer wall of the housing along a respective one of said sides, and said solder tail presenting a major surface adjacent a respective said circuit pad for soldering;

whereby the surface area of each said solder tail adjacent a circuit pad is maximized along said mounting face between said body portion and said contact section.

2. The electrical connector of claim 1 wherein a portion of said body portion defines a retention section adapted to cooperate with a respective said cavity in an interference fit to secure said terminal therein.

3. The electrical connector of claim 2 wherein each said terminal is inserted into a respective one of said cavities from said mating face thereof, and said terminal includes a pair of stop surfaces facing toward said mounting face to abut corresponding stop surfaces of said housing facing toward said mating face, whereby said terminals maintain said housing onto said circuit board after being soldered to circuit pads thereof.

4. A miniature electrical connector adapted for surface mounting to a circuit board having at least a pair of circuit pads spaced apart a selected distance, comprising:

a housing having opposed sides and further having a mating face, an opposed mounting face and at least one pair of terminal-receiving cavities extending therebetween, each of said cavities disposed on a respective one of said sides of said housing, and said housing further includes latches adapted to cooperate with complementary latch members of a mating connector to secure the connectors together in mated condition;

an electrical terminal disposed in each of said cavities, said terminal including a planar body portion having a pair of arms co-extending orthogonally from opposed side edges thereof proximate said mating face defining a U-shaped channel comprising at one end a contact-receiving receptacle open to said mating face, and a solder tail extending from said body portion traversing said U-shaped channel at an opposed end along said mounting face to a contact section adjacent a free end of said solder tail for electrical connection to a respective circuit pad, said body portion being disposed along a central wall of said housing parallel to said sides of said housing, said central wall separating cavities of each said at least one pair of terminal-receiving cavities, and said solder tail of each said terminal extending outwardly of the housing cavity and then being bent at a right angle to said body portion to extend along said mounting face and outwardly away from adjacent said central wall and beyond an outer wall of the housing along a respective one of said sides, and to present a major surface adjacent a respective said circuit pad;

whereby the surface area of each said solder tail adjacent a circuit pad is maximized along said mounting face between said body portion and said contact section.

5. The electrical connector of claim 4 wherein each said terminal is inserted into a respective said cavity from said mating face thereof and includes a pair of stop surfaces facing toward said mounting face to abut corresponding stop surfaces of said housing facing toward said mating face, whereby said terminals maintain said housing onto said circuit board after being soldered to circuit pads thereof.

* * * * *